US009980528B2

(12) United States Patent
Reinhart et al.

(10) Patent No.: US 9,980,528 B2
(45) Date of Patent: May 29, 2018

(54) CONFIGURABLE HEADWEAR ASSEMBLY

(71) Applicant: Centrex Plastics, LLC, Findlay, OH (US)

(72) Inventors: Terrence Lee Reinhart, Findlay, OH (US); Nickolas Lee Reinhart, Findlay, OH (US)

(73) Assignee: Centrex, LLC, Sycamore, OH (US)

( * ) Notice: Subject to any disclaimer, the term of this patent is extended or adjusted under 35 U.S.C. 154(b) by 714 days.

(21) Appl. No.: 14/150,516

(22) Filed: Jan. 8, 2014

(65) Prior Publication Data

US 2015/0189938 A1 Jul. 9, 2015

(51) Int. Cl.
*A42B 1/20* (2006.01)
*A42B 1/06* (2006.01)

(52) U.S. Cl.
CPC ..... *A42B 1/205* (2013.01); *A42B 1/064* (2013.01)

(58) Field of Classification Search
CPC ..... A42B 1/20; A42B 1/205; A42B 1/206; A42B 1/064
USPC ..... 2/195.1, 195.2, 195.4, 171.1, 10
See application file for complete search history.

(56) References Cited

U.S. PATENT DOCUMENTS 2,855,604 A * 10/1958 Austin ..... A42B 3/227 2/171.1
4,333,180 A * 6/1982 Bay ..... A42B 3/227 2/10
4,793,006 A * 12/1988 Dawson ..... A42B 1/065 2/10
4,873,726 A * 10/1989 Tapia ..... A42B 1/064 2/10
5,070,545 A * 12/1991 Tapia ..... A42B 1/064 2/10
5,471,684 A * 12/1995 Casale ..... A42B 1/064 2/10

(Continued)

FOREIGN PATENT DOCUMENTS

WO WO 0074513 A1 * 12/2000 ..... A24B 1/064

OTHER PUBLICATIONS

Oct. 6, 2015 (CA) Office Action Application No. 2,876,832.

*Primary Examiner* — Anna Kinsaul
*Assistant Examiner* — James Heracklis
(74) *Attorney, Agent, or Firm* — Ward Law Office LLC; Jacob M. Ward

(57) ABSTRACT

An article of headwear including a crown component, a brim component, and an elongated attachment component is provided. The attachment component is configured to attach the brim component to the crown component. The attachment component may include a female-type engagement element along a first elongated edge of the attachment component and a flange element along a second elongated edge of the attachment component. The second elongated edge is opposite to the first elongated edge. The female-type engagement element has first and second arms defining therebetween an elongated channel having a length and a depth. The flange element extends in a direction transverse to the length of the channel. The crown component is attached to the flange element. The brim component includes a connection region configured for insertion into the channel. An article of headwear having an attachment component for attaching decorative elements to the headwear is also provided.

36 Claims, 10 Drawing Sheets

(56) References Cited

U.S. PATENT DOCUMENTS 5,481,759 A * 1/1996 Rinaldi ..... A42B 1/061 2/171.1
5,533,211 A * 7/1996 Mehrens ..... A42B 1/064 2/181
5,613,246 A * 3/1997 Alexander ..... A42B 1/064 2/10
5,619,287 A * 4/1997 Tseng ..... A61F 9/02 2/10
5,689,830 A * 11/1997 Pflum ..... A42B 1/065 2/10
5,715,534 A * 2/1998 Mobley ..... A42B 1/064 2/10
5,765,229 A 6/1998 Mcleod et al.
5,862,523 A * 1/1999 Proctor ..... A42B 1/064 2/171
5,870,772 A * 2/1999 Sprouse ..... A42B 1/064 2/10
5,898,935 A 5/1999 Davis
6,122,774 A * 9/2000 Park ..... A42B 1/22 2/181
6,202,218 B1 * 3/2001 Chen ..... A42B 1/065 2/175.1
6,237,156 B1 * 5/2001 Ellman ..... A42B 1/064 2/10
6,385,776 B2 5/2002 Linday
D488,293 S * 4/2004 Norway, Jr. ..... D2/882
6,789,267 B2 * 9/2004 Ahn ..... A42B 1/064 2/175.1
D499,231 S * 12/2004 Toppel ..... D2/882
8,234,721 B1 * 8/2012 Cestare ..... A42B 1/006 2/171.1
8,327,464 B2 * 12/2012 Jaros ..... A41F 1/00 2/243.1
9,078,483 B1 * 7/2015 Snyder ..... A42B 1/247
9,161,584 B1 * 10/2015 Garrett, Jr. ..... A42B 1/004
D748,898 S * 2/2016 Reinhart ..... D2/891
D756,075 S * 5/2016 Reinhart ..... D2/891
9,578,913 B2 * 2/2017 McGoogan ..... A42B 1/064
2002/0000001 A1 * 1/2002 Hall McKenzie ..... A42B 1/064 2/195.2
2004/0040067 A1 * 3/2004 Pong ..... A42B 1/22 2/195.2
2005/0120462 A1 * 6/2005 Cho ..... A42B 1/062 2/195.2
2006/0090235 A1 * 5/2006 Clark ..... A61F 9/045 2/12
2007/0017003 A1 * 1/2007 Harris ..... A42B 1/064 2/195.1
2011/0088141 A1 * 4/2011 Davis ..... A42B 1/064 2/195.1
2015/0189938 A1 * 7/2015 Reinhart ..... A42B 1/064 2/195.2

* cited by examiner

CONFIGURABLE HEADWEAR ASSEMBLY

FIELD OF THE INVENTION

The present invention relates to headwear. In particular, the present invention relates to a headwear assembly having attachable, removable, and/or replaceable portions.

BACKGROUND

Headwear, such as hats or caps, may include a crown and a brim. The crown typically extends over the top and around the front, back, and/or sides of the user's head. The crown covers and protects at least a portion of the user's scalp region from the elements (sunlight, wind, rain, snow, etc.). The brim extends outward from the crown of the headwear and outward from the front, back, and/or sides of the user's head. The brim provides the face and/or the neck of the user with extended protection from the elements.

Different types of headwear provide different functionalities. For example, a wide-brimmed hat may provide an enhanced degree of extended protection from the elements. However, such a wide-brimmed hat may limit a user's movement, in that fast or sharp movements may cause the wide-brimmed hat to blow off or fall from the head. Further, wide-brimmed hats may limit a user's vision. Thus, as another example, a baseball cap with a forwardly extending bill may provide sufficient protection for a user's face, while at that same time allowing greater freedom of movement. Its relatively tight-fitting crown holds the baseball cap snugly to the user's head.

Today, in addition to providing various functionalities, various types of headwear are also selected for aesthetic purpose. Users may select their headwear to display a user's personality via choice of style, materials, colors, etc. Even further, the simple utilitarian cap has evolved into another piece of the iconic world of collectibles. Caps are not only functional pieces of clothing, but also offer many fine branding surfaces. The comparative inexpensive nature of the cap design and low manufacturing cost have been seized upon by the marketing world as a prime valued give-away opportunity, with the gifts emblazoned with all manner of team logos, company logos, themes, colors, etc. Thus, a baseball cap, for example, may include logos or color schemes consistent with a team, school, brand, company, employer, charity, etc., such that the user displays an affiliation upon wearing the cap.

Various caps or hats provided with movable, attachable, and/or detachable components for changing the functional and/or aesthetic characteristics of the cap are known. U.S. Pat. No. 5,070,545 to Tapia discloses an adjustable baseball type cap assemblage having a crown portion and various interchangeable visor portions. U.S. Pat. No. 5,471,684 to Casale discloses a sports hat construction with a brim portion detachable secured to the head covering portion. U.S. Pat. No. 5,613,246 to Alexander discloses a cap with a removable and reversible visor. U.S. Pat. No. 5,715,534 to Mobley discloses a hat having a movable brim or visor. U.S. Pat. No. 5,870,772 to Sprouse discloses a sports cap having a rotatable visor on a track assembly. U.S. Pat. No. 5,898,935 to Davis discloses a cap with an adjustable visor section. U.S. Pat. No. 0,488,293 to Norway, Jr. discloses a baseball cap with interchangeable bills. These patents provide various means for customizing the user's headwear by reconfiguring the various components of the cap or hat.

These known caps may require significant manipulation to move, attach or detach the various components. Further, the various known mechanisms for enabling the movement, attachment and/detachment may be relatively complex, thereby being relatively expansive to produce. Even further, the various known mechanisms may not provide satisfactory stability or rigidity between the movable or attached components and/or the attachment mechanism may prove to be unreliable. A configurable headwear assembly overcoming some or all of these various deficiencies in the prior art may be desirable.

SUMMARY OF THE INVENTION

The present invention relates to articles of headwear having crown and brim components that are attachable to one another.

According to certain aspects, an article of headwear including a crown component, a brim component, and an elongated attachment component is provided. The attachment component may be configured to attach the brim component to the crown component. The attachment component may include a female-type engagement element along a first elongated edge of the attachment component and a flange element along a second elongated edge of the attachment component. The second elongated edge is opposite to the first elongated edge. The female-type engagement element may have first and second arms defining therebetween an elongated channel having a length and a depth. The flange element may extend in a direction transverse to the length of the channel. The crown component may be attached to the flange element. The brim component may include a connection region configured for insertion into the channel. The article of headwear may be a baseball-type cap or a visor-type cap.

According to other aspects, a kit for an article of headwear may include at least one crown component, at least one brim component, and at least one elongated attachment component. The elongated attachment component may be configured to attach the brim component to the crown component. The elongated attachment component may include a flange element extending along a first elongated length and one of a female connection portion or a male connection portion extending along a second elongated length. The brim component may include the other of the female connection portion and the male connection portion. The female connection portion and the male connection portion are configured for complementarily engaging one another and may be portion are configured for releasably engaging one another.

According to some aspects, an article of headwear may include a crown component, a brim component, and an elongated attachment component, wherein the elongated attachment component may include a male-type engagement element along a first elongated edge of the attachment component and a flange element along a second elongated edge of the attachment component. The male-type engagement element may be complementarily configured for engaging a female-type engagement element provided on the brim component or on the crown component. The flange element extends in a direction transverse to the engagement direction of the male-type engagement element to the female-type engagement element. The male-type engagement element may be complementarily configured for releasably engaging the female-type engagement element.

According to even other aspects, an article of headwear may include a crown component, a brim component, and an elongated attachment component, wherein the elongated attachment component may include a male-type engagement element along a first elongated edge of the attachment component and a female-type element along a second elongated edge of the attachment component. The male-type engagement element provided on the elongated attachment component may be complementarily configured for engaging a female-type engagement element provided on the brim component or on the crown component. The female-type engagement element provided on the elongated attachment component may be complementarily configured for engaging a male-type engagement element provided on the brim component or on the crown component. The male-type engagement elements may be complementarily configured for releasably engaging the female-type engagement elements.

According to certain aspects, an article of headwear may include at least one of a crown component or a brim component having an exterior major surface and an attachment component may be located on the exterior major surface. The attachment component may have an elongated length. Further, the attachment component may include a mounting plate and a female-type engagement element projecting transversely from a major surface of the mounting plate. The female-type engagement element may have first and second arms defining a channel extending along the elongated length of the attachment component. The article of headwear may include both a crown component having an exterior major surface and a brim component having an exterior major surface, and a first attachment component may be located on the exterior major surface of the crown component and a second attachment component may be located on the exterior major surface of the brim component. The article of headware may include a decorative element having a connection region configured for insertion into the channel of the attachment component. Further, the attachment component may be configured for releasable engagement to the decorative element.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description, will be better understood when read in conjunction with the accompanying drawings.

DETAILED DESCRIPTION

The following discussion and accompanying figures disclose articles of configurable headwear and systems associated therewith. The general concepts and features of the article of headwear that are disclosed may be applied to a wide variety of headwear, including men's headwear, women's headwear, gender-neutral headwear and children's headwear, such as baseball caps, visor-type caps, sun hats, cowboy hats, tennis or bucket hats, panamas, newsboys, fedoras, etc. Further, the general concepts and features of the present invention may be applied to headwear composed of a wide variety of materials, whether floppy, flexible, stiff, resilient, or hard, whether natural or synthetic, whether woven, knitted, felted, molded, multi-layered, etc. Example materials include natural fibers, synthetic fibers, straw, fur, leather, cellulose, plastics, rubbers, etc. Example material forms include woven fabrics, knit fabrics, felted fabrics, fused fabrics, cardboard, meshes, molded, extruded, cast, sheet, solid and/or foamed plastics, etc., including combinations thereof. Even further, the headwear may be size adjustable, such that it may fit or accommodate a range of different head sizes. Size adjustment may be provided via elastic portions, flexible components, and/or releasable fastening elements such as snaps, clasps, buckles, ties, hook and loop elements, friction slides, zippers, etc., as would be known in the art. Optionally, the article of headwear may be fitted, i.e., not size adjustable.

Figure 1:
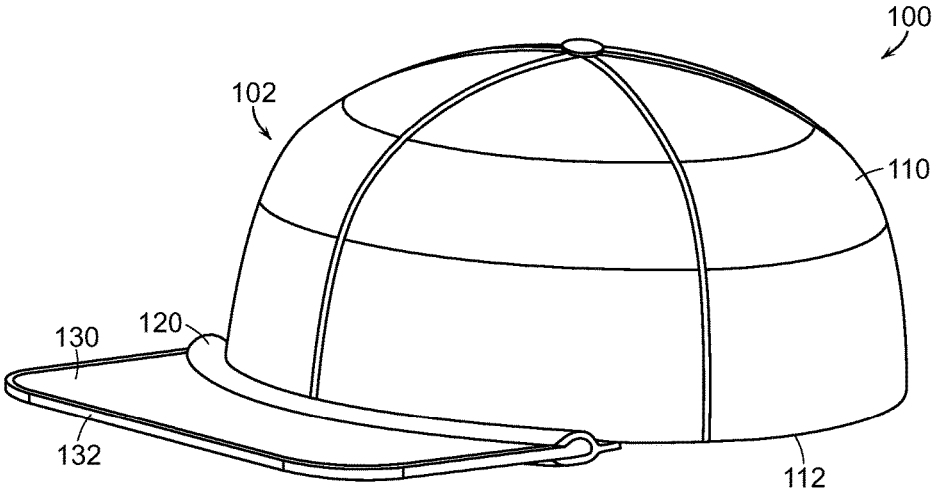
FIG. 1 is a first perspective view of an article of headwear having a crown component, a brim component and an attachment component in accordance with an aspect of the present invention wherein the article of headwear is a baseball-type cap.
Figure 2:
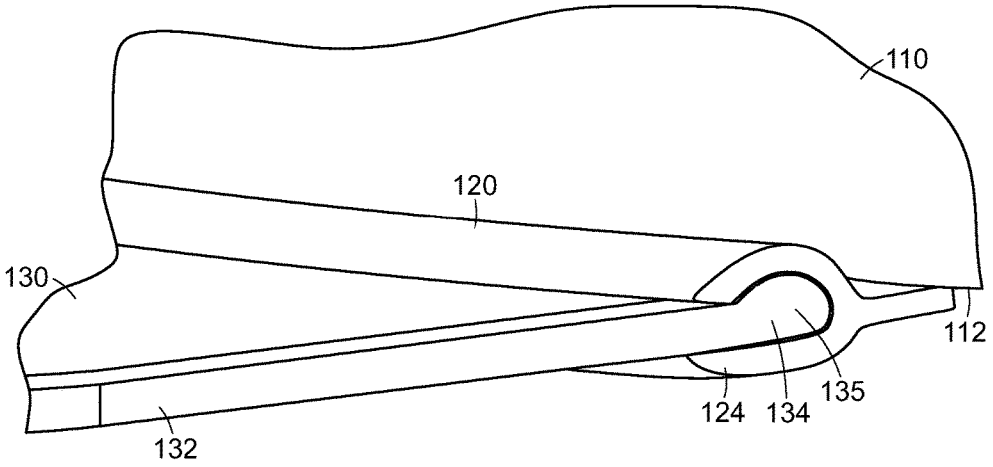
FIG. 2 is an enlarged portion of the first perspective view of FIG. 1, showing the details of the engagement of the brim component to the attachment component.

FIG. 1 is an article of headwear 100 according to aspects of the invention. In this particular embodiment, although the headwear 100 is illustrated as a baseball cap 102, the disclosed concepts may be applied to a variety of headwear.

Figure 4:
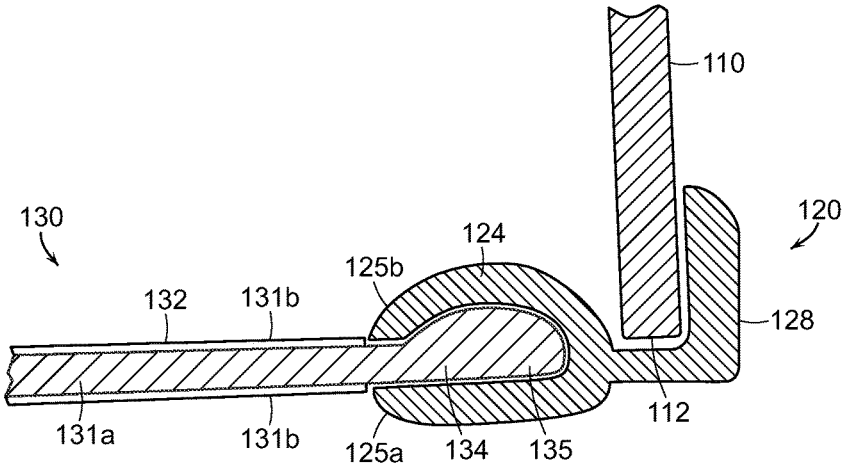
FIG. 4 is a cross-section view of a portion of the article of headwear of FIG. 1, schematically illustrating the engagement of the attachment component to the brim component and to the crown component.

Portions or regions of the article of headwear 100 may be described in terms of their normal spatial relation to a user's head (e.g., top, front, back, left side, right side, etc.), in terms of their normal association with a user's anatomy (e.g., forehead, crown, temple, ear, nape, cranium, etc.), and in terms of their orientation when placed on an upright head (e.g., horizontal, vertical, up, down, etc.). FIG. 4 illustrates horizontal and vertical axes. The term "scalp," as used herein refers to the area of a user's head covered (or once covered) with hair follicles.

Attachment of Brim Component

According to certain aspects as shown, for example, in FIGS. 1-4, headwear 100 includes a crown component 110 and a brim component 130 attached thereto with a crown-to-brim attachment component 120. All three components 110, 120, 130 may be formed and provided separately. Optionally, a crown component 110 may be joined to the attachment component 120 and provided as a crown subassembly 150 (see FIG. 3). Alternatively, a brim component 130 may be joined to the attachment component 120 and provided as a brim subassembly 160 (see FIG. 3). The brim component 130 may be detachably or releasably attached to the attachment component 120. Further, the crown component 110 may be detachably or releasably attached to the attachment component 120.

The terms "detachably attached" or "releasably attached" refers to an attachment that is designed to be relatively easily undone without damaging the attached parts during the detaching process. A detachable attachment requires only nominal forces to detach the parts from one another. As an example, a resilient, elastically deformable, snap fitting, which can be unsnapped without being destroyed, so as to allow for two parts to come apart, is a detachable attachment. This is true, even if a special tool is required to unsnap the components. The opposite of a detachable attachment is a non-detachable or permanent attachment.

Figure 3:
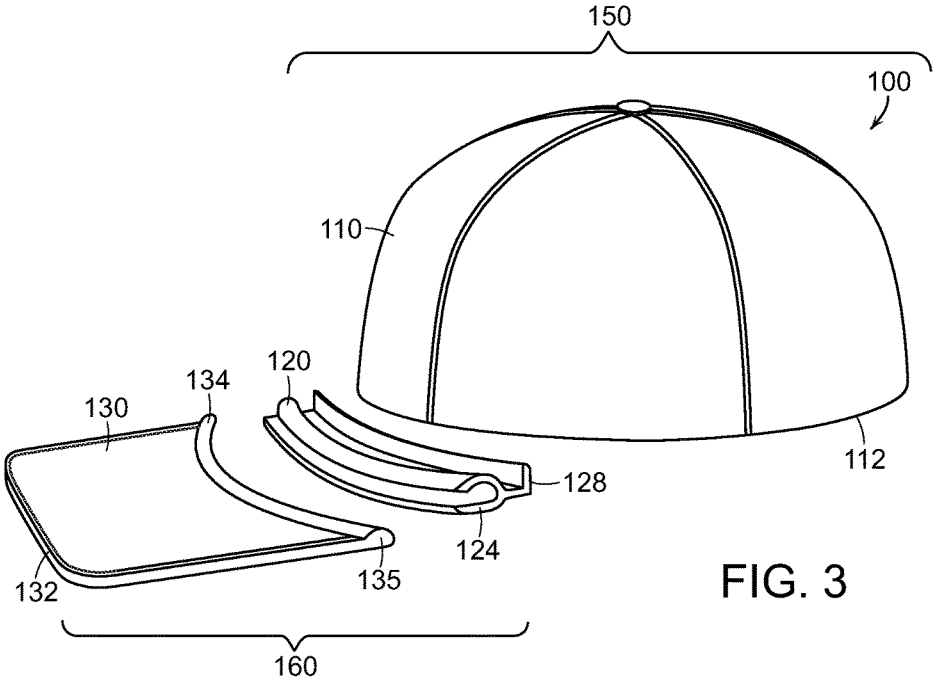
FIG. 3 is an exploded perspective view of the article of headwear of FIG. 1.

Referring to FIGS. 1 and 3, the crown component 110 refers to the portion of the headwear 100 that generally extends over and/or around the user's head. The crown component 110 generally extends alongside and/or over at least a portion of the user's cranium and may follow the contours of the user's head. A majority of a crown component 110 may fit the user's head relatively snugly, as would a baseball cap or a bomber hat. Alternatively, a majority of a crown component 110 may relatively loosely cover the user's head, as would, for example, a tennis or bucket hat. In a bucket hat, the crown component 110 may include a hat band that somewhat snugly fits a circumferential perimeter of a user's head such that the hat does not easily fall or blow off, and a top covering that may be spaced from the top of the user's head to provide a more relaxed fit. The hat band may be moisture absorbing and/or formed of material having wicking properties; the top covering may be ventilated. As even another option, a crown component 110 may be relatively stiff and formed to maintain a specific shape whether on or off the user's head. For example, the crown component 110 of a fedora may have a headband that somewhat snuggly fits a circumferential perimeter of a user's head, and a shape-maintaining top covering that only slightly conforms to the side contours of a user's head and that maintains a non-conforming distance from the top of the user's head. As another non-limiting example, a crown component 100 may consist primarily of a headband portion that extends around at least a portion of the circumferential perimeter of a user's head, generally at least from ear-to-ear via the forehead. The crown component 110 of a tennis visor-type cap (or an eyeshade-type cap) includes such a headband portion only and does not include any top covering that extends up and over the top or crown of the user's head.

In the particular embodiment of FIG. 1 and as also shown in FIG. 3, the crown component 110 is dome-shaped or generally hemispherical with a perimeter edge 112 that extends circumferentially around a user's head. The crown component 110 may be formed, for example, from multiple components sewn or otherwise assembled together or as a single, unitarily molded component. For example, a rounded dome crown component may be made of a variety of possible fabric segments sewn, or otherwise joined, together, coming to a common intersection point at the top of the cap and spreading out toward the lower circumference in substantially triangular shapes. A button or other decorative item may be provided at the point of convergence of the segments. The roughly triangular shapes are typically spaced such that either a segment is centered on the front of the cap or a seam between two segments is centered at the front of the cap. The number, size and shapes of the segments and their placement or spacing may vary, but typically between four and eight segments may be provided to form the crown component. Alternatively (not shown), the crown component 110 may be formed as a series of side-by-side strips or longitudinal bows running from the front to the back. Other construction techniques for the crown component 110 may include patch work, thermoforming or thermosetting of impregnated materials, plastic construction, etc.

Optionally, one or more portions of the crown component 110 may include multiple layers of material. For example, the lower edge of the joined segments or strips may be folded over to provide additional thickness and structural integrity in the hat band area. An inner hat band (not shown) may extend around at least a portion of the perimeter edge 112. For baseball caps, the hat band may be an annular ring of structural fabric that centers along the brow line and extends around at least a majority of the head. For fixed-size caps, the hat band may extend all the way round the head; for adjustable caps, the hat band may be joined to an adjustment feature. Example adjustment features include buckles or other slidably adjustable members, snaps or other snap-fit connectors, hook-and-loop material, and/or elastic members that provide either mechanical or elastic adjustment. Generally, the hat band is provided with sufficient surface area and compliance so as to conform to the unique head shape and size of the wearer and maintain a comfortable seating friction between the headwear and the user's head so that the headwear maintains its position during a wearer's activities. The hat band may also serve to maintain the shape of the headwear. Further, the hat band may serve as a natural point of attachment for both the components forming the crown component 110 and any visor or brim features joined to the crown component 110. Finally, the hat band may also serve as a sweat band, capturing perspiration along the brow and protecting the eyes from sweat droplets during physical exertion. Thus, depending upon the intended use, the complexity or the cost of the headwear, the hat band may be padded, sweat "wicking," or simply a strip or band of heavier material (e.g., canvas, leather, synthetic leather, etc.) to provide the desired fit and structural properties.

The brim component 130 is attached or joined to the crown component 110, typically as shown in FIG. 1, to the perimeter 112 of the crown component 110. The brim component 130 may extend along only a portion of the perimeter of the crown component 110. In the embodiment shown in FIG. 1, the brim component 130 is attached to a front portion or region of the perimeter 112 of the crown component 110. In this particular embodiment, the brim component 130 is located in the front of the baseball cap 102 at the brow line, where it may block or diffuse the sun, thereby protecting the user's eyes from the direct rays of the sun. The brim component 130 may be a composite of both cloth and backing board. The backing board may be made from a variety of substrates, including needle-punched fabrics, card stock, felts, molded plastics, and/or other materials that provide a fairly stiff member that withstands movement and resists degradation due to moisture and the rigors of doffing and mounting. In preferred embodiments, the backing board may also allow some shaping by the owner.

Alternatively, in other embodiments (see for example, FIG. 12), the brim component 130 may extend all the way around a circumferential perimeter of the crown component 110. In contrast to the crown component 110 which typically extends alongside the contours of a user's head, the brim component 130 typically extends away from the user's head. According to some embodiments, the brim component 130 may extend away from the user's head in a generally horizontal orientation. Cowboy hats, panamas, sun hats, and baseball caps are examples of headwear having generally horizontally extending brim components 130. According to other embodiments, the brim component 130 may be folded upward or may generally hang downward from the perimeter of the crown component 110. A sailor's cap (as sometimes worn by Gilligan with the brim flipped up), the upright front portion of a trapper's hat, or the classic Russian Cossack hat are examples of headwear having brim components that extend or are folded upward. The relaxed, floppy brim of a bucket cap or the ear flap portions of a bomber cap are examples of brim components 130 that generally hang downward from the perimeter of the crown component 110.

Figure 10:
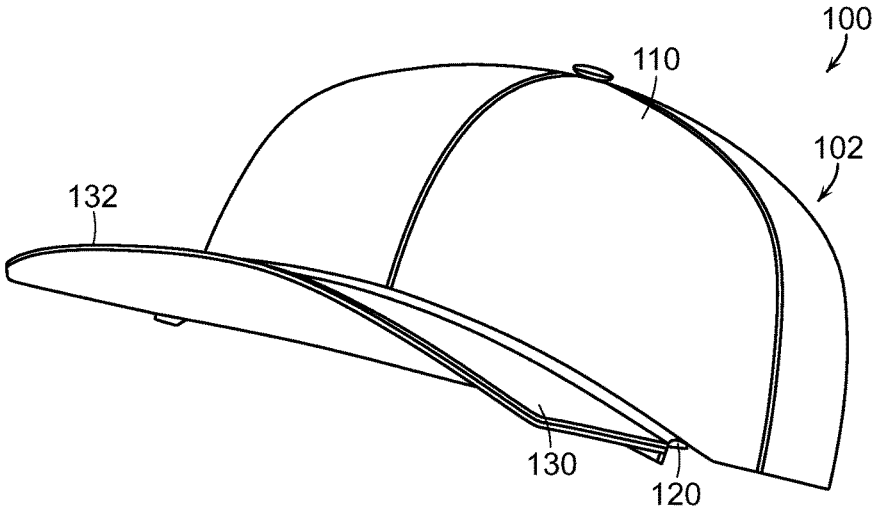

In the particular embodiment of FIG. 1, which is a baseball cap 102, the brim component 130 may be formed as a bill 132. As used herein, a "bill" is a relatively stiff component projecting (i.e., cantilevered) from a portion of the crown component 110. A bill 132 holds its shape and typically is stiffer than the crown component 110 to which it is attached. Thus, the bill 132 is attached to and extends generally horizontally or laterally outwardly from a front region of the perimeter 112 of the crown component 110. Typically the bill 132 extends from the crown component 110 in the vicinity of the user's forehead region and provides the user's face with extended protection from the elements. As is known, baseball caps may be worn backwards or to the side, in which case the bill 132, although extending outwardly from a front region of the crown component 110 would not be positioned in the vicinity of the user's forehead when worn. The bill 132 may be flat or optionally it may be provided with a slight curvature extending over and concavely facing the user's brow line (see e.g., FIG. 10).

The brim component 130 may be formed from one or more layers. As known in the art, for example referring to FIG. 4, a bill 132 may include a semi-rigid visor board 131*a* sandwiched between textile or other sheet-like elements 131*b*. Bill 132 may incorporate a conventional visor board configuration, wherein the visor board is formed of card stock or other cellulosic material. Optionally, the visor board may be formed of a molded, cast, extruded, or drawn plastic. Example plastics include polyvinyl chloride, polyvinyl acetate, polyethylenes, and their copolymers. Even further, the bill 132 may be formed as a unitary component, rather than the sandwich structure described above. For example, bill 132 may be formed from a single sheet of solid or foamed plastic.

According to further aspects of the invention and referring to FIGS. 1-13, the article of headwear 100 includes an attachment component 120. Attachment component 120 is located between the brim component 130 and the crown component 120 and provides a means for attaching or securing the brim component 130 to the crown component 110. In the embodiments of FIGS. 1-13, attachment component 120 may be formed separately from the crown component 110 and subsequently attached, releasably or otherwise, thereto. Further, attachment component 120 may be formed separately from the brim component 130 and subsequently attached, releasably or otherwise, thereto. All three components 110, 120, 130 may be formed and provided separately. However, as noted above, the attachment component 120 may be assembled to the crown component 110 and provided as a crown subassembly 150 (see FIG. 3). Optionally, the attachment component 120 may be assembled to the brim component 130 and provided as a brim subassembly 160 (see FIG. 3). According to aspects of the invention, attachment component 120 may be attached to one or both of crown component 110 and brim component 130.

Figure 5:
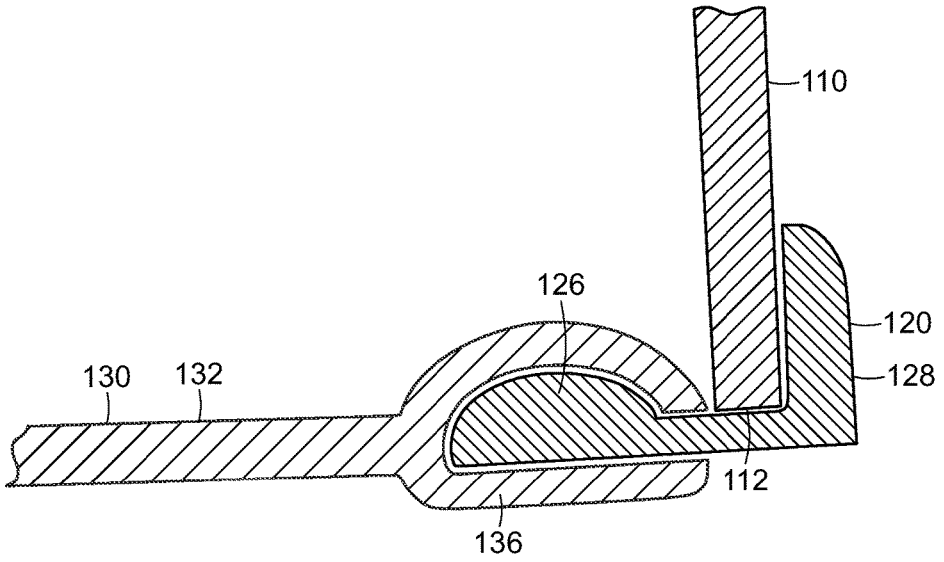
FIG. 5 is a cross-section view of a portion of another embodiment of the article of headwear, schematically illustrating the engagement of the attachment component to the brim component and to the crown component.
Figure 6:
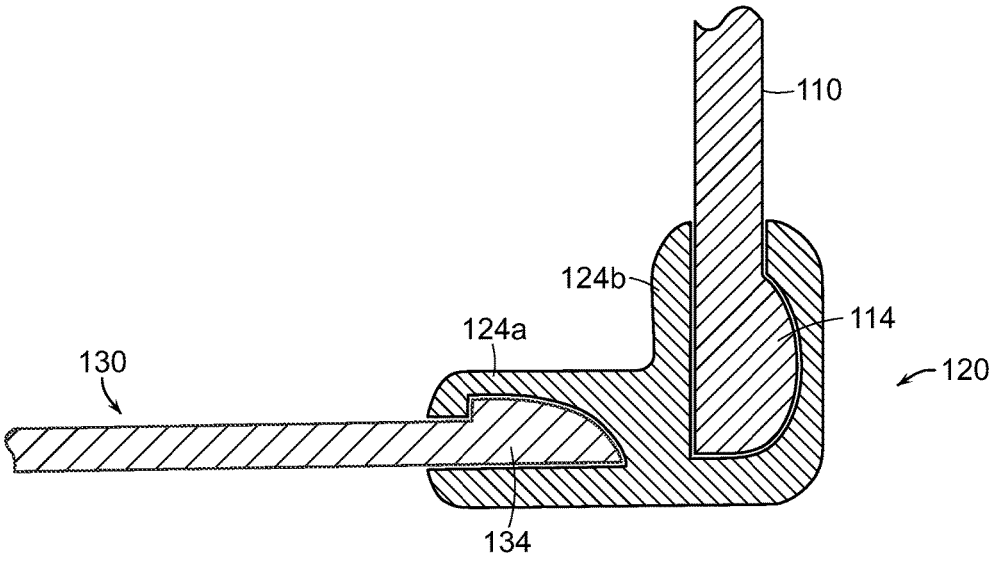
FIG. 6 is a cross-section view of a portion of even another embodiment of the article of headwear, schematically illustrating the engagement of the attachment component to the brim component and to the crown component.

Referring to FIGS. 4-6, attachment component 120 may include at least one of a female-type engagement element 124 (i.e., a receptacle, socket, cavity, recess, etc.) or a male-type engagement element 126 (i.e., a protrusion, knob, protruberance, plug, etc.) configured for engaging a complementarily formed connection element on either the crown component 110 or the brim component 130. In the exemplary embodiment of FIG. 4, the attachment component 120 may include a female-type engagement element 124 and brim component 130 may include a complementarily-formed male-type connection element 134. In other embodiments, for example referring to FIG. 5, attachment component 120 may include a male-type engagement element 126 configured for complementarily and engaging a female-type connection element 136 on brim component 130. Attachment component 120 may optionally include both a male-type engagement element 126 and a female-type engagement element 124. The male-type engagement element 126 of attachment component 120 may be provided to engage either the brim component 130 or the crown component 110, and the female-type engagement element 124 may be provided to engage the other of the brim component 130 and the crown component 110. Further, attachment component 120 may include two male-type engagement elements 126 or two female-type engagement elements 124. Thus, for example referring to FIG. 6, attachment component 120 may include a first female-type engagement element 124*a* configured for engaging a complementarily-shaped connection element 134 on brim component 130 and may further include a second female-type engagement element 124*b* configured for complementarily engaging a connection element 114 on crown component 110. In this example embodiment, both connection element 134 and connection element 114 are configured as male-type connection elements. These complementarily-shaped male-type and female-type engagements elements may be configured for releasable attachment of the attachment component to the brim and/or crown components 130, 120.

Alternatively, attachment component 120 may be removably or releasably attached to one of crown component 110 or brim component 130, for example, via snaps, buttons, hook-and-loop type fasteners, clips, etc. Even further, attachment component 120 may be permanently attached to one of crown component 110 or brim component 130, for example, via adhesives, stitching, bonding, etc. Thus, attachment component 120 may be provided with flanges 128 or other portions for accommodating hook-and-loop attachments, adhesives, stitching, etc.

Attachment component 120 may be formed as an elongated element extending in a longitudinal direction. Further, attachment component 120 may extend linearly, may curve such that the engagement elements 124, 126 are curved in the plane of their engagement (see FIGS. 1 and 3) and/or may curve such that the engagement elements 124, 126 are curved out of the plane of their engagement (see FIG. 10).

Attachment component 120 may be formed from a polymeric material. The polymeric material may be extruded, stamped, drawn, molded, cast, and/or formed via additive manufacturing techniques such as three-dimensionally printing, stereolithography, etc. Further, the polymeric material may be foamed or solid. Suitable polymeric materials for the attachment component may include polyethylenes (PE), polypropylenes, acetals, acrylics, nylons (polyamides), polystyrenes, polyvinyl chlorides (PVC), acrylonitrile butadiene styrenes (ABS) polycarbonates, and their copolymers. Additionally, the attachment component 120 may be formed of as a composite, having strengtheners and/or fillers provided within a polymeric matrix material. If desired, the attachment component 120 may be formed from a metallic material.

The brim component 130 may include a connection element 134 that is configured for engagement to attachment component 120 (i.e., to the remainder of the article of headwear 100). As best shown in FIG. 3, the connection element 134 may be an elongated element that extends along a perimeter portion of the brim component 130. Further, the connection element 134 may be formed as a male-type insertion element. Thus, for example, the connection element 134 may be formed as a bead, rib, flange(s), or other feature having a cross-section thickness that is enlarged relative to a cross-section thickness of the brim component 130. As one example, the connection element 134 may be formed as a flattened bead 135, wherein the cross-section thickness of the flattened bead 135 is greater than an at-large, average thickness of the brim component 130. As another example (not shown), the connection element 134 may be formed by indenting or reducing the cross-section thickness of the brim component 130 to form a necked-down region immediately adjacent the connection element 134. In such case, the connection element 134 may have a cross-section thickness substantially the same as the average at-large thickness of the brim component 130, while the necked-down region would have a cross-section thickness that is less than the at-large average thickness of the brim component 130. According to even another embodiment, connection element 134 may be provided as a simple extension of the at-large region of the brim component 130, being neither enlarged nor necked-down. In such an instance, the connection element 134 may be retained within the complementary female-type engagement feature 124 of the attachment component 120 due to friction, interference fits, elastic deformation of the attachment component, etc. Further, one or more detent features (not shown) may be provided to assist in the retention of the connection element 134 within engagement feature 124.

Connection element 134 may be unitarily and/or integrally formed with the brim component 130. Thus, for example, the bill 132 may be stamped or molded with the connection element 134 created during the stamping or molding process. Optionally, the bill 132 may be formed as a sheet of solid or foamed plastic that is co-molded or over-molded to the connection element 134.

As best shown in FIGS. 1 and 3, the attachment component 120 may be formed as an elongated member having a first elongated edge and a second elongated edge opposite to the first elongated edge. An engagement element 124, 126 may extend at least partially along its first elongated edge. As shown in FIG. 4, a female-type engagement element 124 may be formed as a clip having a socket or channel portion defined by a first arm 125*a* and a second arm 125*b*. Female-type engagement element 124 may be configured to complementarily engage and retain the connection element 134 of brim component 130. Specifically, connection element 134 may be configured for insertion into the complementarily-formed female-type engagement element 124 provided by attachment component 120.

Female-type engagement element 124 may be formed as an elongated channel, track, groove, etc. that extends along the length of attachment component 120. An elongated channel includes a length extending from a first end to a second end, a depth extending from the channel opening to its back wall, and a width extending from across the depth. The channel may extend linearly, may curve in the plane of the channel (see FIGS. 1 and 3) and/or may curve out of the plane of the channel (see FIG. 10).

The attachment component 120 may also include a flange element 128. The flange element is provided along the second elongated edge of the attachment component 120. Specifically, the flange element 128 extends from the rearward end of the engagement element 124 in a direction that is transverse to the length and transverse to the depth of the channel. The flange element 128 longitudinally extends along the length of the engagement element 124 (and also along the length of the attachment component 120). The flange element 128 may parallel the elongated channel of the engagement element 124, and as such it may extend linearly, may curve in the plane of the channel and/or may curve out of the plane of the channel. Optionally, the elongated channel of the female engagement element 124 may be linear and the flange element 128 may curve (or vice versa).

Referring specifically to FIG. 4, the first arm 125*a* of the female engagement element 124 may be oriented substantially parallel to (and, optionally, substantially in the same plane as) the plane of the brim component 130. The second arm 125*b* of the channel or socket may form a concave surface facing the first arm 125*a*. Typically, at least one of the first arm 125*a* and the second arm 125*b* of the female engagement element 124 may define a concave surface facing the other of the first arm 125*a* and the second arm 125*b*. The concavity of the arms 125*a*, 125*b* may extend around an enlarged portion of the connection element 134, thereby enhancing the retention capability of the attachment component 120.

In a sliding-type engagement method, an end of connection element 134 may be inserted into an end of the elongated channel of the engagement element 124 and then connection element 134 may be longitudinally slid within the elongated channel forming engagement element 124. Attachment component 120 may have a longitudinal length that is approximately equal to a width of the brim component 130. Thus, according to certain embodiments, connection element 134 may be considered to be fully engaged with engagement element 124 when the ends of the elements 124, 134 are aligned with each other. As such, the brim component 130 may be slidably coupled to the crown component 110 via an attachment component 120. In other words, in the sliding-type of engagement, a male engagement feature may slide into a female engagement feature by inserting the male engagement feature into an end of a longitudinally extending channel defining the female engagement feature and then sliding the male engagement feature in the longitudinal direction along the channel until the male and female engagement features are aligned.

In a pushing-type engagement method, connection element 134 may be pushed into engagement element 124 in a direction parallel to the depth of the channel (and transverse to the longitudinal extension of the channel) that forms engagement element 124. As connection element 134 is pushed between the arms 125*a*, 125*b* of the female-type engagement element 124, the free ends of the arms 125*a*, 125*b* may deflect away from each other and then snap into place over the connection element 134. To facilitate and reduce the loads associated with this pushing-type engagement, the pushing, deflecting, and snapping may occur at a first point along the length of the channel and then travel down the length of a channel in a continuous zipper-type (i.e., merging) engagement action. Thus, the brim component 130 may be resiliently coupled to the crown component 110. Specifically, a male engagement feature may be configured to resiliently engage or snap into engagement with a female engagement feature by pushing the male engagement feature into the female engagement feature and thereby flexibly deforming at least a part of one or both the engaging portions of the male and female engagement features. This resilient engagement may also include a sequentially continuous, traveling, convergence-type insertion of the male engagement feature into the female engagement feature. This zipper-type action may generally involve applying a pinching, insertion force as a lengthwise-traveling force across the male and female engagement features such that pincer-type engagement occurs sequentially along the moving direction of the applied force.

Still referring to FIG. 4, flange element 128 may extend vertically upward alongside the portion of crown component 110 that lies adjacent to the lower perimeter edge 112. According to certain embodiments, flange element 128 may be attached (releasably or permanently) to an inner surface of this portion of the crown component 110 (via stitching, adhesive, hook-and-loop, snaps, etc.).

Thus, according to certain aspects, an article of headwear 100 may include a crown component 110, a brim component 130, and an attachment component 120 provided to attach the brim component 130 to the crown component 110. The attachment component 120 may be releasably engaged to the brim component 130 via complementary male and female engagement elements 124, 134 or 126, 136. As described above, the brim component 130 may include a male portion, such as connection element 134; the attachment component 120 may include a female engagement element 124.

Similarly, the crown component 110 may be attached, via male- and female-type engagement portions to the attachment component 120. The attachment component 120 may be releasably engaged to the crown component 110 via complementary male and female engagement elements 124, 114 (see, e.g., FIG. 6). As described above, the crown component 110 may include a male-type portion, such as connection element 114; the attachment component 120 may include a female-type engagement element 124*b*. Alternatively (not shown), the crown component 110 may include a female-type engagement element and the attachment component 120 may include a male-type engagement element.

Thus, according to certain embodiments, the crown component 110 may be permanently attached to the attachment component 120, and the brim component 130 may be detachably or releasably attachable to the attachment component 120. The brim component 130 may be provided with a male-type connection element 134 and the attachment component 120 may be provided with the complementary female engagement element 124. Alternatively, the brim component 130 may be provided with a female-type connection element 136 and the attachment component 120 may be provided with a complementary male engagement element 126.

According to other embodiments, the brim component 130 may be permanently attached to the attachment component 120, and the crown component 110 may be detachably or releasably attachable to the attachment component 120. The crown component 110 may be provided with a male-type connection element 114 and the attachment component 120 may be provided with a female engagement element 124. Alternatively, the crown component 110 may be provided with the female-type connection element and the attachment component 120 may be provided with the male engagement element.

According to even other embodiments, both the brim component 130 and the crown component 110 may be detachably or releasably attachable to the attachment component 120. Thus, referring to FIG. 6, the attachment component 120 may be provided with a first female engagement element 124*a* for attachment to the brim component 130 and a second female engagement element 124*b* for attachment to the crown component 110. In such case, both the brim component 130 and the crown component 110 may be provided with complementary male-type connection element 134, 114, respectively. Alternatively, the attachment component 120 may be provided with a first male-type engagement element for attachment to the brim component 130 and a second male-type engagement element for attachment to the crown component 110. Then, both the brim component 130 and the crown component 110 may be provided with complementary female-type connection elements, respectively. Further, the attachment component 120 may be provided with a female-type engagement element 124 for attachment to one of the brim component 130 and the crown component 110 and with a male-type engagement element 126 for attachment to the other of the brim component 130 and the crown component 110.

In some example preferred embodiments, the cross-sectional shape of a male-type connection element 134 may complementarily match the cross-sectional shape of the female-type engagement element 124. Further, the cross-section thickness of a neck region of the brim component 130 may complementarily match an opening dimension of the female-type engagement element 124. Thus, the connection element 134 may snugly reside within female-type engagement element 124. According to certain embodiments, the connection element 134 and the female-type engagement element 124 may be configured to transmit a moment across the engagement region. In other words, the specific configuration of the engagement region components may restrain or inhibit relative rotation of the connection element 134 relative to the female-type engagement element 124. For example, referring to FIG. 4, the arms 125*a*, 125*b* may be elongated as they extend away from flange element 128 such than an elongated channel or socket cross-section is formed. Correspondingly, the connection element 134 may be provided with a horizontally elongated or vertically flattened bead. Because this flattened bead is not spherical, is it restricted from rotating within the female engagement element 124. Thus, the brim component 130 is essentially cantilevered from the attachment component 120 and drooping of the brim component 130 relative to the attachment component and relative to the crown component 110 is lessened. Relative rotation between the brim component 130 and the attachment component 120 may additionally, or alternatively, be limited by curving the elongated channel such that any cantilever loading of the brim component 130 may be reacted or anchored over the longitudinally-curved extent of the entire channel. According to even another example embodiment, connection element 134 may be slightly larger than female engagement element 124, such that upon engagement with one another, the arms 125*a*, 125*b* of female engagement element 124 are deflected outward, thereby applying a spring-loaded clamping force to connection element 134. The free ends of the arms 125*a*, 125*b* of the female engagement element 124 may extend into and engage the neck region of the brim component 130.

According to some embodiments, at least one of mating components may include an alignment or registration element. For example, the male engagement element 134 or the female engagement element 124 may include a registration element 129. The registration element 129 may assist in ensuring that the brim component 130 (or crown component) is properly position and/or aligned with respect to the attachment component 120. For example, referring to FIG. 9, the registration element 129 may be formed as a wall or other stop element 129*a* located at one end of the elongated channel defining the female engagement element 124. When the brim component 130 slides along the attachment component 120, the connection element 134 will slide within the channel until it comes up against the stop 129*a*. Thus, a user would easily recognize that the brim component 130 is properly and fully inserted relative to the attachment component 120. Alternatively, a registration element 129 may be formed as a wall or other stop element (not shown) located at one end of a male engagement element 126 extending along the length of the attachment component 120. As another embodiment, the registration element 129 may be formed as a detent or other resistance element. Although such a resistive registration element will not absolutely stop the relative motions between the brim component 130 and the attachment component 120, it will provide the user with an indication that the components are properly aligned with respect to one another. Persons of ordinary skill in the art would understand that registration elements may also be provided on the connection elements 114, 134 of the crown or brim components 110, 130, given the benefit of this disclosure.

In baseball cap embodiments, the crown component 110 covers a majority of the scalp or top region of the user's head. In other embodiments, the crown component 110 may cover less of the user's head. For example, the article of headwear 100 may be a visor-type cap (see FIG. 7) and, as such, the majority of the user's scalp may be uncovered when the visor-type cap is worn. In even other embodiments, the crown component 110 may cover more of the user's head. For example, the article of headwear 100 may be a cloche or a bomber cap, each of which extends over the ears and nape of the user.

Figure 7:
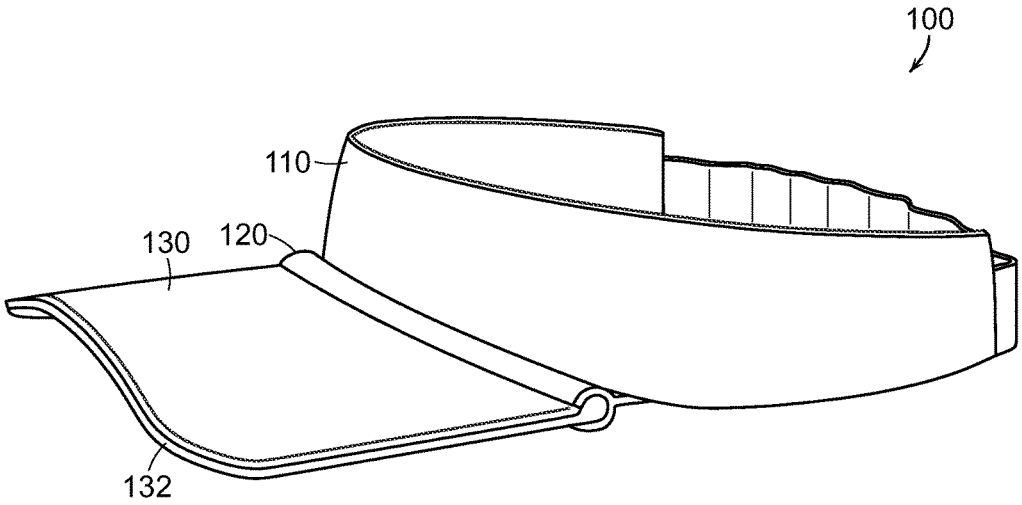
FIG. 7 is a perspective view of an article of headwear having a crown component, a brim component and an attachment component in accordance with an embodiment of the present invention wherein the article of headwear is a visor-type cap.
Figure 8:
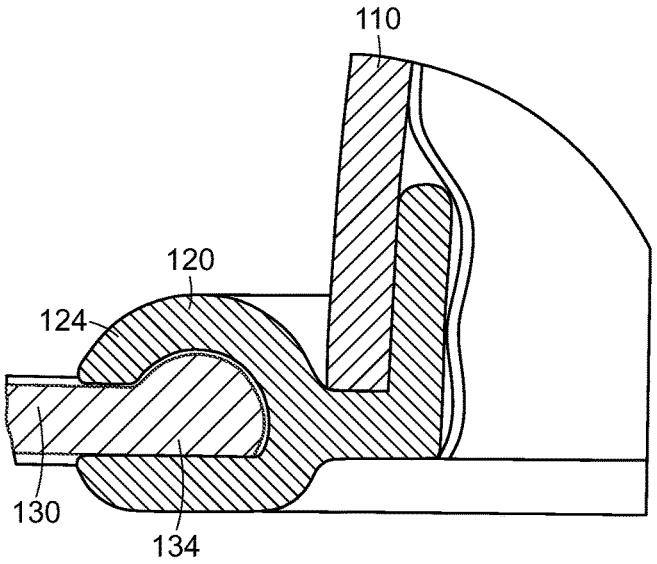
FIG. 8 is a cross-section view of a portion of the article of headwear of FIG. 7, schematically illustrating the engagement of the attachment component to the brim component and to the crown component.
Figure 9:
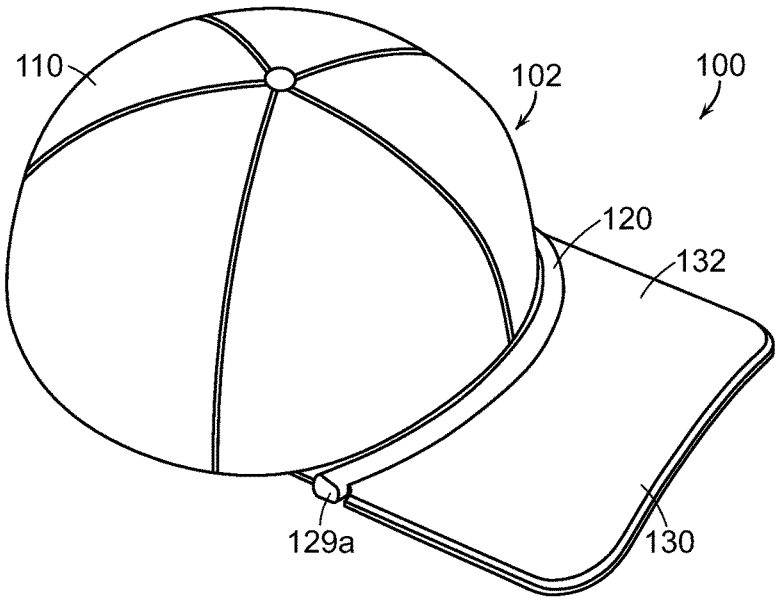
FIGS. 9 and 10 are perspective views of another embodiment of the article of headwear.

FIG. 7 also illustrates that attachment component 120 extends linearly in the plane of the channel formed by engagement portion 124. In other words, the attachment component 120 does not follow the general curvature of a user's forehead, but rather extends straight across. FIG. 8 illustrates a variation of the configuration of the attachment component 120 wherein the female-type engagement portion 124 more rounded (i.e., less elongated) than the configuration shown in FIG. 4. Correspondingly, the male-type engagement feature 134 of brim component 130 is also more rounded. This configuration of attachment component 120 may lie closer to the crown component 110 and thus, be less noticeable, than the configuration of FIGS. 1 and 4.

Figure 11:
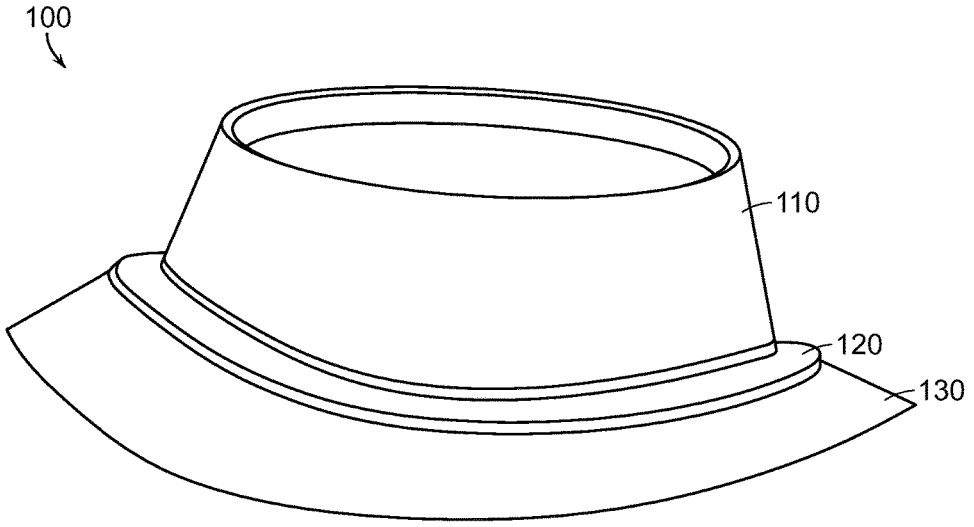
FIG. 11 is a side perspective view of even another embodiment of the article of headwear.
Figure 12:
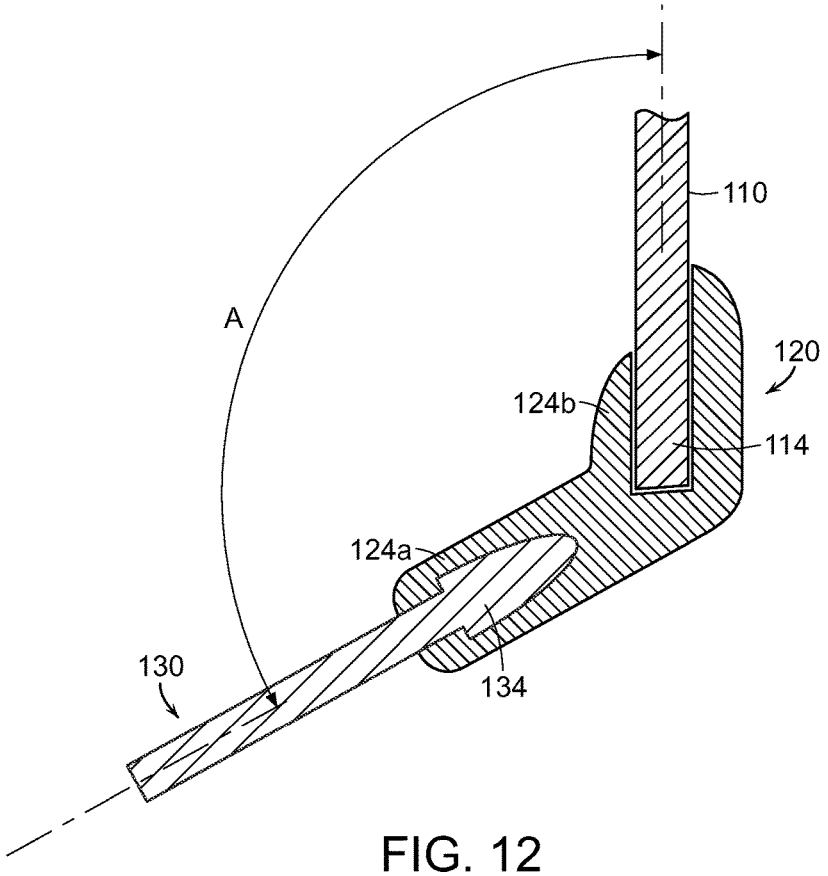
FIG. 12 is a cross-section view of a portion of the article of headwear of FIG. 11, schematically illustrating the engagement of the attachment component to the brim component and to the crown component.

FIGS. 11 and 12 illustrate an additional embodiment of an article of headwear 100 according to the invention, in which a bucket-type hat is assembled from a crown component 110, a brim component 130 and an attachment component 120. In this embodiment, both the attachment component 120 and the brim component 130 extend completely around the perimeter edge of crown component 110. Further, as best shown in FIG. 12, an angle A between the engagement portions of the attachment component 120 is greater than 90 degrees. Thus, the brim component 130 may be attached at an obtuse angle relative to the crown component 110. As previously shown, the brim component 130 may be attached at a generally right angle relative to the crown component 110. Even further, it is understood that if the angle A between the engagement portions of the attachment component 120 is less than 90 degrees, the brim component 130 may be attached at an acute angle relative to the crown component 110. According to some aspects, the angle A may be varied to provide different angles of attachment of the brim component 130 to the crown component 110.

Configurable System for Creating Article of Headwear

Figure 13:
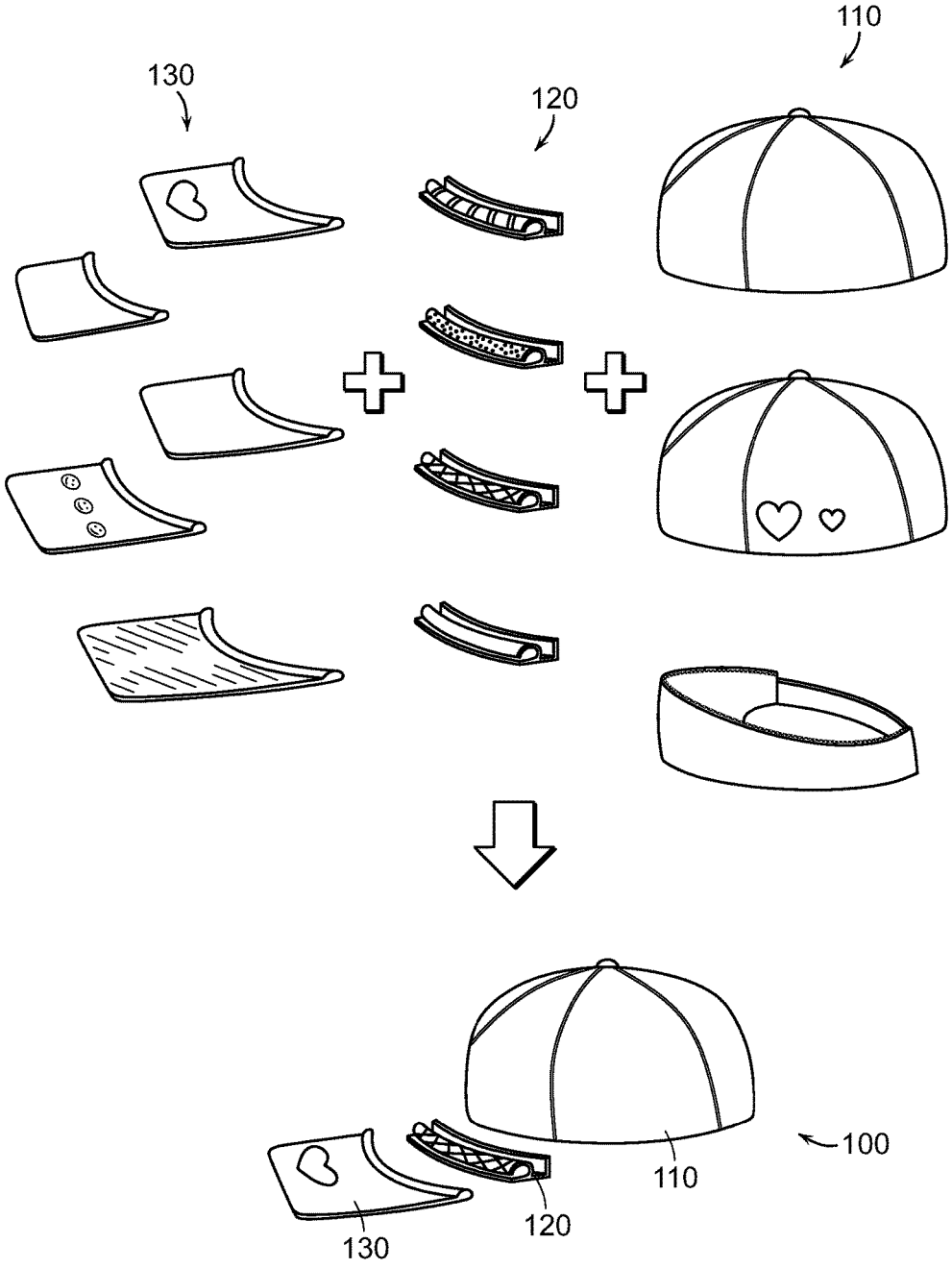
FIG. 13 is a schematic illustrating a system for creating a customized article of headwear according to a further aspect of the invention.

According to aspects of the invention disclosed above and referring to FIG. 13 a system for creating a customized article of headwear may be provided. In a configurable headwear system a plurality of various crown, brim, and/or attachment components 110, 130, 120 may be provided such that different combinations of crown, brim, and/or attachment component crown, brim, and/or attachment components 110, 130, 120 may be assembled to form an article of headwear 100. As such, certain of the crown, brim, and/or attachment components 110, 130, 120 may be interchangeable or substitutable.

As used herein, the terms "interchangeable" or "substitutable" refer to items that may be used in place of one another. Interchangeable items may be, but need not be, identical to one another. For example, a first component may be attachably interchangeable with a second component in that both the first and the second components may be configured for alternative attachment to a third component. Interchangeable components are not necessarily detachably interchangeable. For example, two components are attachably interchangeable if each could be attached to a third component in place of the other. However, once the attachment of one of the components is formed with the third component, if the attachment is permanent, then even though the two components were attachably interchangeable, they are not detachably interchangeable. Only if the components are both detachably attachable and interchangeable are they detachably or releasably interchangeable.

At least some of the crown components 110 may have different characteristics from other of the crown components 110. Further, at least some of the brim components 130 may have different characteristics from other of the brim components 130. Even further, at least some of the attachment components 120 may have different characteristics from other of the attachment components 120. Thus, for example, a system for a configurable article of headwear may include one or more crown components 110, one or more brim components 130, and/or one or more attachment components 120. The attachment components 120 may each be configured to releasably attach the brim components 130 to the crown components 110.

Thus, according to certain aspects, a customer may select a crown assembly 150 from a plurality of crown assemblies 150 and a brim component 130 from a plurality of brim components which are configured for interchangeable attachment to the selected crown assembly 150. According to certain embodiments, the brim component 130 may then be permanently attached to the crown assembly 150 to form the ultimate headwear 100. Such permanent attachment may be performed at the point of sale, or optionally by the user at their leisure. As a non-limiting example, a suitable adhesive may be used to permanently attach the brim component 130 to the crown assembly 150. As another example, stitching may be used to permanently attach the attachment component 130 to the crown assembly 150.

According to other aspects, it may be desirable to have a more versatile component assembly system, whereby one could freely attach and then detach the different headwear components from one another. This would allow customers to freely personalize and assemble their article of headwear 100. A plurality of crown assemblies 150 may be provided and a plurality of brim components 130 that are configured for releasable and/or interchangeable attachment with the crown assemblies 150 may be provided. A customer may mix and match any of the crown assemblies 150 with any of the brim components 130.

According to even other aspects, the headwear system may be provided as a plurality of crown components 110, a plurality of brim components 130, and a plurality of attachment components 120. A customer may select a crown component 110 from a plurality of crown components 110, a brim component 130 from a plurality of brim components 130 which are configured for interchangeable attachment to the selected crown component 110, and an attachment component 120 from a plurality of attachment components 120 which are configured for interchangeable attachment to the selected crown and brim components 110, 130. According to certain embodiments, the attachment component 120 may then be permanently attached to the crown component 110 to form a crown assembly 150 (i.e., a crown component 110 assembled to an attachment component 120). Such permanent attachment may be performed at the point of sale, or optionally after sale by the user. As a non-limiting example, a suitable adhesive may be used to permanently attach the attachment component 120 to the crown component 110. As an example, a flange 128 of the attachment component 120 may be permanently attached to the crown component 110 with stitching (see e.g., FIGS. 4 and 5). Even further, optionally, the attachment component 120 may be detachably attached to the crown component 110 via engagement portions 114, 124 as disclosed above. As other non-limiting examples, the attachment component 120 may be attached to the crown component 110 with hook-and-loop fasteners, snaps, buttons, clips, etc. as would be known to persons of skill in the art given the benefit of this disclosure. The selected brim component 130 may be engaged to the crown component 110 via complementary engagement portions 124, 134 or 126, 136 (see e.g., FIGS. 4 and 5)

According to some aspects, a customizable or configurable headwear system may be sold as a kit. A kit for an article of headwear 100 may include at least one crown component 110, at least one brim component 130, and at least one attachment component 120. As a non-limiting example, the attachment component 120 may be configured to releasably attach the brim component 130 to the attachment component 120 and to permanently attach the crown component 110 to the attachment component 120. Thus, the attachment component 120 may include a flange element 128 along a first edge and one of a female engagement element 124 or a male engagement element 126 along a second edge. The brim component 130 may include the other of the female-type or male-type connection element 134, 136. The engagement element 124, 126 of the attachment component 120 and the connection element 134, 136 of the brim component 130 may be configured for complementarily engaging one another. Alternatively, a kit may include a plurality of brim components 130. The brim components 130 may be configured for interchangeable attachment to the attachment component 120. The attachment component 120 may be supplied separately, as for example, an interchangeable attachment to a crown component 110, or may be supplied as a permanent attachment to a crown component 110.

As one embodiment of a kit, a plurality of brim components 130, which are configured for releasable and interchangeable attachment to a particular model of crown component 110, may be packaged together. For example, a first releasable and interchangeable brim component 130 of a first school color may be packaged with a second releasable and interchangeable brim component 130 of a second school color. The customer may purchase a crown component 110, for example, of the first school color, and a packaged pair of complementary school color brim components 130. Optionally, according to certain embodiments, a kit may include the crown component 110 in addition to the two (or more) releasable and interchangeable brim components 130. Alternatively, according to other embodiments, a kit may include a plurality of crown components 110 and a plurality of brim components 130. For example, a pair of complementary school color crown components 110 may be provided in the kit along with a plurality of releasable and interchangeable brim components 130 provided with different versions of the schools logo and/or color schemes. As another example, a kit may include a plurality of crown components 110 wherein a first crown component 110 is configured as a baseball cap-type crown and a second crown component 110 is configured as a visor cap-type crown. The kit may include a plurality of releasable and interchangeable brim components 130. For example, the kit may include a first brim component 130 as a translucent plastic sun screen and a second brim component 130 as a cloth-covered bill. The first and second brim components 130 need not be the same size or shape. For example, the second brim component 130 may project out from the wearer's face farther than the first brim component 130. Alternatively, according to even other embodiments, a kit may include a plurality of attachment components 120. For example, a kit may include a plurality of crown components 110, a plurality of brim components 130, and a plurality of attachment components 120. Each of the attachment components 120 may be of a different color, material, shape, etc. Variations of the kits and the components in the kits would be apparent to persons of ordinary skill in the art, given the benefits of this disclosure.

Attachment of Decorative Components

According to certain additional aspects and referring to FIGS. 14-18, headwear 100 may include one or more decorative elements 170 and decorative element attachment components 180. According to these aspects of the invention, the article of headwear 100 may include a brim component 130 and may further include an attachment component 120 securing a brim component 130 to a crown component 110 as disclosed above with respect to FIGS. 1-13. Alternatively, the decorative elements 170 and/or decorative element attachment components 180 may be provided with headwear configurations as known in the prior art.

The decorative elements 170 may be detachably or releasably attached to the decorative element attachment component 180. Further, the attachment component 180 may be detachably or releasably attached to the brim component 130 and/or to the crown component 110. Alternatively, the decorative elements 170 may be permanently attached to the decorative element attachment component 180 and/or the attachment component 180 may be permanently attached to the brim component 130 and/or to the crown component 110. By way of non-limiting examples, attachment component 180 may be permanently attached to the brim component 130 and/or to the crown component 110 via adhesive, stitching, co-molding, vibration welding, etc., or detachably attached via snaps, hook-and-loop fasteners, clips, straps, etc. Similarly, permanent attachment of the decorative elements 170 to the attachment components 180 may be achieved by, for example, applying adhesive between the otherwise releasable components and/or by, as another example, providing a locking feature that prevents disassembly. Permanently attaching the attachment component 180 to the brim and/or crown components 130, 110 may be preferred as it may more securely and stably join decorative elements 170 to the headwear 100. On the other hand, releasably joining the decorative elements 170 to the attachment components 180 may be preferred as it may provide a greater degree of personalization of the headwear 110.

Figure 14:
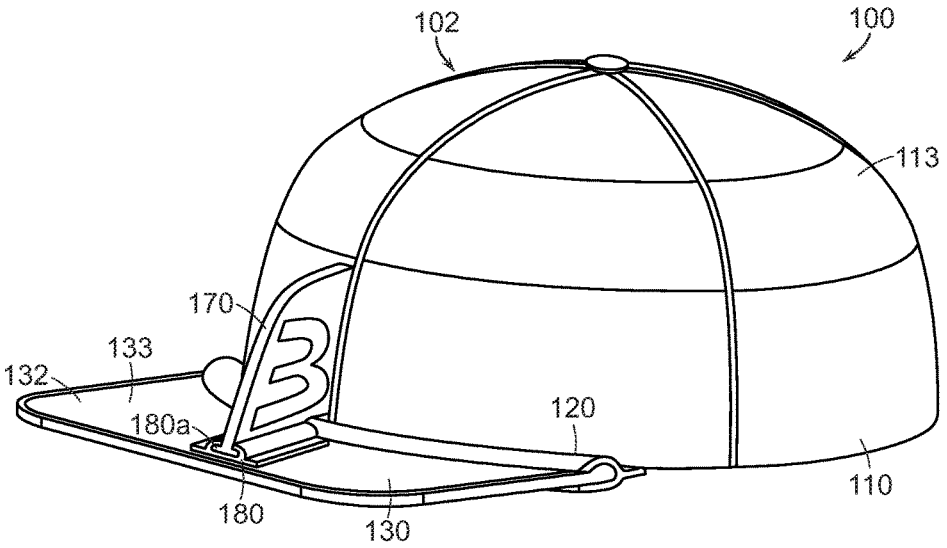
FIG. 14 is a perspective view of an embodiment of a decorated article of headwear according to another aspect of the invention FIGS. 15A and 15B schematically illustrate a decorative element and a complementary portion of an attachment component, respectively, according to the example embodiment of FIG. 14.

Thus, according to certain aspects and referring to FIG. 14, an article of headwear 100 may include at least one of a crown component 110 having an exterior major surface 113 and a brim component 130 having an exterior major surface 133. For purposes of this disclosure an exterior major surface is defined as the surface (curved, planar, stepped, etc.) that forms the outer covering of the component and that extends between the perimeter edges of the component. The attachment component 180 may be permanently or releasable engaged to the exterior major surface 113 of the crown component 110 and/or to the exterior major surface 133 of the brim component 130. More than one attachment component 180 may be provided. Thus, a first attachment component 180 may be located on the exterior major surface 133 of the brim 130 and a second attachment component 180 may be located on the exterior major surface 113 of the crown component 110.

Figure 15A:
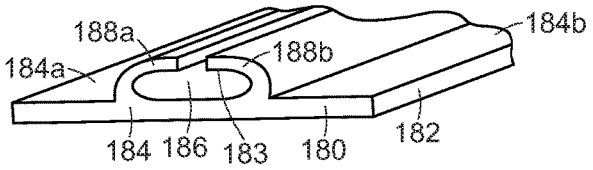
Figure 15B:
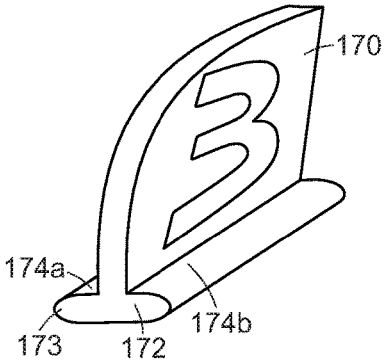

As shown in the example embodiment of FIGS. 14, 15A and 15B, the attachment component 180 may have an elongated length. For example, the attachment component 180 may be provided as a dorsal rail 180*a* attached to a brim component 130, such as a bill 132 of a baseball cap 102. In this embodiment, the attachment component 180 is located along a centerline of the brim component 130 and extends from the front edge to the rear edge in the dorsal direction of the brim component 180. Other locations, orientations and extents of the attachment component 180 to the brim component 130 are within the scope of this invention. For example, the attachment component 180 may crosswise or generally side-to-side direction. Additionally, more than one attachment component 180 may be attached to the brim component 130.

Referring more specifically to FIGS. 15A and 15B, attachment component 180 may include a female-type engagement element 182 and the complementary attachment feature 172 on the decorative element 170 may be a male-type engagement element. Optionally, the attachment component 180 may include a male-type engagement element and the complementary attachment feature on the decorative element may be a female-type engagement element. In general, such male and female-type engagement elements may slidingly engage one another, may be snap fit together, may include interference fits, may elastically clip together, may be pinned together, etc.

Attachment component 180 may be provided with a track 183 within which a complementarily-shaped slider 173 provided on decorative element 170 may slide. In such an arrangement, the track 183 and slider 173 need not be continuous nor need they be coextensive. Thus, for example (not shown), the attachment component 180 may be provided with a first track portion located on the forward portion of the bill 132 and a second, aligned, track portion located on the rearward portion of the bill 132, and the attachment feature 172 may be provided as shown in FIG. 15B, with a slider 173 that engages both track portions and extends therebetween. Other variations in the track 183 and the slider 173 would be apparent to persons of ordinary skill in the art, given the benefit of this disclosure.

In the specific embodiment of FIGS. 14, 15A and 15B and referring specifically to FIG. 15A, the attachment component 180 includes an elongated mounting plate or base plate 184 with the female-type engagement element 182 projecting therefrom. A longitudinally-extending T-shaped slot or channel 186 is defined between a pair of elongated projecting flanges or arms 188*a*, 188*b*. The elongated base plate 184 includes elongated side portions longitudinally 184*a*, 184*b* extending adjacent to and alongside the elongated projecting flanges 188*a*, 188*b*, such that the mounting footprint of the female-type engagement element 182 is greater than the footprint of the T-shaped slot 186. The larger mounting footprint may provide sufficient surface area to adhesively mount the female-type engagement element 182 to the bill 132 and resist peel and/or shear stresses and/or the side portions 184*a*, 184*b* may provide an accessible surface for stitching or otherwise mechanically attaching the track 182 to the brim component 130. Attachment component 180 may be provided with a relatively low profile or height, such that the visual impact of the attachment component 180 when located on the brim component 130 is minimized should there, for instance, be no decorative element 170 engaged thereto.

As further shown in FIG. 15A, decorative element 170 may be formed as a relative planar panel having a pair of elongated, laterally extending, flanges 174*a*, 174*b* forming the attachment feature 172 which is complementarily shaped to slide or fit within the T-shaped slot 186 of component 180. In this embodiment, one end of attachment feature 172 may be inserted into the open front end of track 183 and then decorative element 170 may be slidingly engaged to attachment component 180.

In general, decorative element 170 may have any form and may be made of any material, including for example, thermoplastic or thermoset materials, combinations of plastics and fabrics, card stock (laminated or unlaminated), stamped sheet material (metal, plastic, paper, etc.), natural materials, such as feathers, fur or leather, etc. and other materials as would be apparent to persons of ordinary skill in the art, given the benefit of this disclosure. These decorative elements 170 may include brand names, product logos, team logos, college slogans and may be marketed under license, sold and/or given away as gifts or promotional items to the users. As further examples, decorative elements 170 may be injection molded in various sizes, shapes (both 2-D and 3-D), of various material, finishes, colors, decals, etc. Optionally, the attachment feature 172 may be unitarily molded with the remainder of the decorative element 170.

The various decorative elements 170 may be sold or bought as a prepackaged kit or separately. Further, options may be provided for personalizing the decorative elements 170, including: providing decorative elements 170 of sufficient size so as to allow for cutting with scissors to make shapes or outlines at the discretion of the user, providing cut-outs or punch-outs for initials, words, symbols or other designs; providing decals, etc. Even further, decorative elements 170 may also serve a functional purpose. For example, an angler may be able to attach and/or swap out any of various panels for holding lures, depending upon the time of year and/or the fish being sought. A hiker may attach a bear bell, an insect deterrent, and/or a waterproof match container. A jogger may attach an MP3 player, etc. Thus, this invention provides a simple, cost effective means for the customization of articles of headwear.

Figure 16:
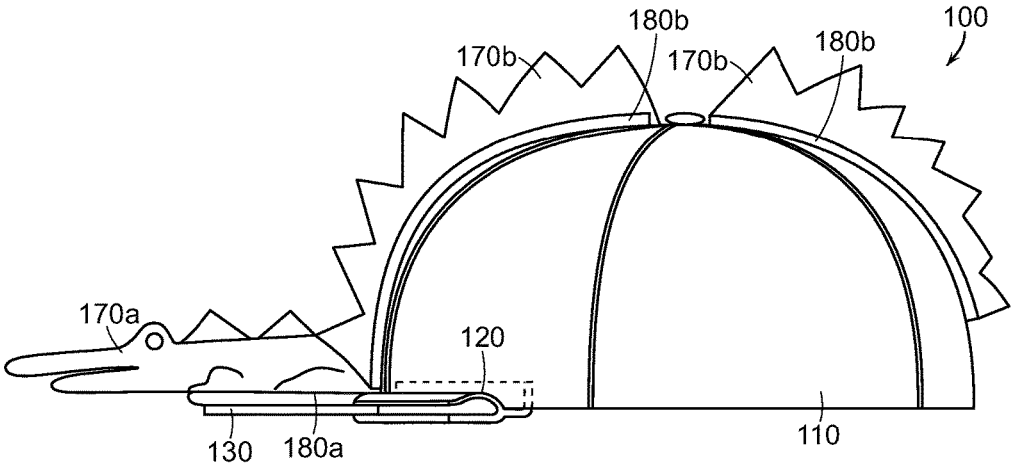
FIGS. 16-18 illustrate various example embodiments of decorated articles of headwear according to aspects of the invention.
Figure 17:
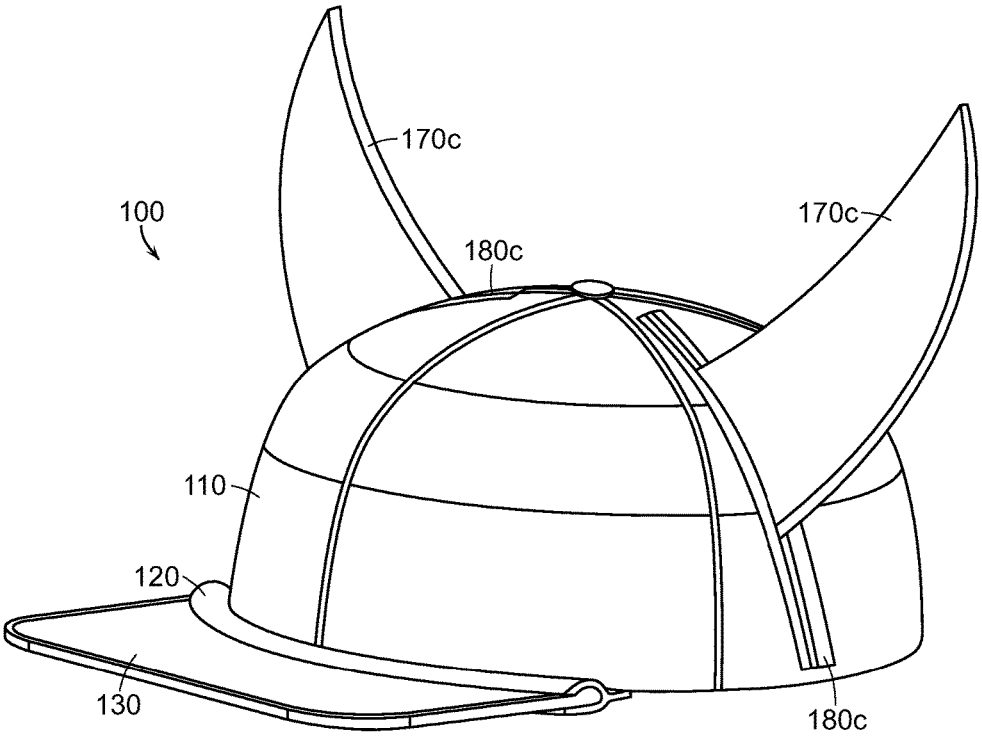
Figure 18:
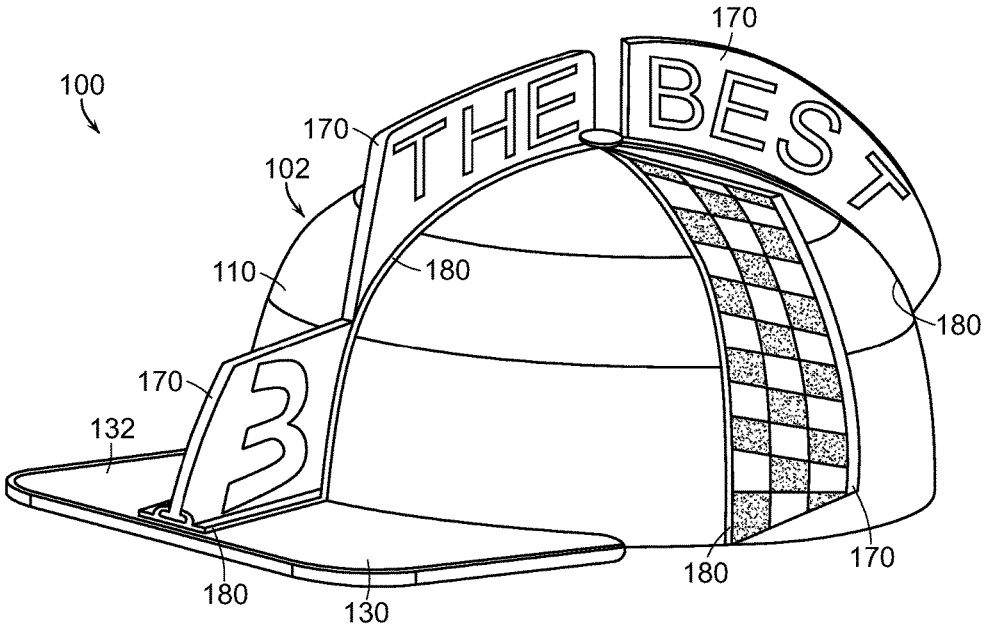

FIGS. 16-18 illustrate example embodiments of attachment components 180 located on the crown component 110 and/or on the brim component 130. According to these embodiments, decorative elements 170 may thus be permanently or detachable located on the exterior major surfaces of the crown component 110 and/or of the brim component 130 of an article of headwear 100. FIG. 16 illustrates an attachment component 180*a* located on the brim component 130 and a pair of attachment components 180*b* located on the crown component 110. These attachment components 180*a*, 180*b* may be formed as "dorsal" rails, in that they extend in a dorsal direction (i.e., generally from the front to the rear of the headwear). As shown, these attachment components 180*a*, 180*b* may be located on the centerline of the components 130, 110. In FIG. 16, the decorative element 170*a*, which is mounted on the brim component 130 via attachment component 180*a*, and the decorative elements 170*b*, which are mounted on the crown component 110 via attachment components 180*b*, form a unified theme. FIG. 17 illustrates a pair of elongated attachment components 180*c* located on the crown component 110 and extending crosswise (i.e., generally ear-to-ear) over the crown component 110. The decorative elements 170*c*, which are mounted on the crown component 110 via attachment components 180*c*, are not coextensive with attachment components 180*c* in that the elongated attachment components 180*c* extend, on either side, beyond the decorative elements 170*c*. FIG. 18 illustrates that a plurality of attachment components 180 and/or decorative elements 170 may be located on the article of headwear 100. Variations in the location, orientation, size, length, configuration, arrangement, etc. of the one or more attachment components 180 to the crown and/or brim components 110, 130 and/or of the complementarily-engaged attachment features 170 would be apparent to persons of ordinary skill in the art, given the benefit of this disclosure.

System for Customizing the Article of Headwear

According to even other aspects of the invention and referring to FIGS. 14-19, a system for customizing articles of headwear may be provided. In such a customizable headwear system a plurality of various decorative elements 170 are configured for engagement with attachment components 180. The attachment components 180 may be offered already assembled to any of a plurality of various articles of headwear and/or may be offered as components ready to be attached to any of the various crown and/or brim components 110, 130 discussed above. The various decorative elements 170 may be provided as interchangeable or substitutable with one another.

Thus, according to certain aspects, a customer may select an article of headwear 100 from a plurality of articles of headwear 100 and one or more decorative elements 170 from a plurality of decorative elements which are configured for interchangeable attachment to the selected article of headwear 100 via decorative element attachment components 180. A customer may mix and match any of the decorative elements 170 with any of the articles of headwear 100.

According to certain aspects, the decorative element 170 may then be permanently attached to the headwear 100. Such permanent attachment may be performed at the point of sale, or optionally by the user at their leisure.

According to other aspects, it may be desirable to have a more versatile component assembly system, whereby one could freely attach and then detach the different decorative elements 170 from the article of headwear 100. This would allow users to more freely personalize and assemble their article of headwear 100. A plurality of articles of headwear 100 may be provided and a plurality of decorative elements 170 that are configured for releasable and/or interchangeable attachment with the various headwear 100 may be provided.

According to some aspects, a customizable or configurable headwear decoration system may be sold as a kit. Such a kit may include an article of headwear 100 (or individual components 110, 130, and/or 120 for an article of headwear), at least one attachment component 180 and at least one decorative element 170. The attachment component 180 may already be assembled to a brim component 130 and/or to a crown component 110. As a non-limiting example, the decorative element 170 may be configured to releasably attach to the attachment component 180. Alternatively, a kit may include a plurality of decorative elements 170 and a plurality of attachment components 180. The article of headwear 100 (or the individual components 110, 130, 120) may be sold separately. The attachment components 180 may be subsequently attached to the article of headwear 100 (according to the desires of the end user) and then any of the various decorative elements 170 may be engaged with the attachment components 180 to form a customized article of headwear 100. A plurality of decorative elements 170, which may be configured for releasable and interchangeable attachment to the attachment components 180, may be packaged together. Variations of these kits and the components in the kits would be apparent to persons of ordinary skill in the art, given the benefits of this disclosure.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

We claim:

1. An article of headwear comprising:

a crown component having a perimeter edge;

a brim component; and an elongated attachment component provided to attach the brim component to the crown component along the perimeter edge, the elongated attachment component including a female-type engagement element and a flange element attached to the crown component, the female-type engagement element having first and second arms defining therebetween an elongated channel opening in a first direction that extends away from the perimeter edge of the crown component, wherein the flange element extends initially away from the female-type engagement element in a second direction opposite the first direction toward the perimeter edge of the crown component and then upwardly along the crown component, and wherein the brim component includes a connection region configured for insertion into the channel.

2. The article of headwear of claim 1, wherein the brim component is releasably attached to the elongated attachment component.

3. The article of headwear of claim 1, wherein the brim component is slidably coupled to the elongated attachment component.

4. The article of headwear of claim 1, wherein the connection region of the brim component is configured to resiliently engage the female-type engagement element of the elongated attachment component by pushing the connection region in the depth direction into the channel.

5. The article of headwear of claim 1, wherein the flange element of the elongated attachment component is secured to an inner surface of the crown component.

6. The article of headwear of claim 1, wherein the connection region of the brim component is integrally formed with the remainder of the brim component.

7. The article of headwear of claim 1, wherein the elongated channel curves along its length around a horizontal axis.

8. The article of headwear of claim 1, wherein the elongated attachment component is formed from an extruded foamed polymer.

9. The article of headwear of claim 1, wherein the elongated channel curves along its length around a vertical axis.

10. The article of headwear of claim 1, wherein the article of headwear is a baseball cap with a decorative assembly attached.

11. The article of headwear of claim 1, wherein the article of headwear is a visor-type cap.

12. A kit for an article of headwear comprising:

a crown component having a perimeter edge;

a brim component; and an elongated attachment component, wherein the elongated attachment component is configured to releasably attach the brim component to the crown component along the perimeter edge, wherein the elongated attachment component includes a flange element and a female connection portion, and the brim component includes a male connection portion, and wherein the female connection portion includes a channel element configured for receiving the male connection portion in a first plane that is transverse the flange element, wherein the brim component includes the male connection portion and wherein the male connection portion lies in substantially the same plane as the remainder of the brim component, and the flange element configured to extend initially in a second direction opposite the first direction toward the perimeter edge and then upwardly along the crown component when the brim component is attached to the crown component, wherein the brim component includes the other of the female connection portion and the male connection portion, wherein the female connection portion and the male connection portion are configured for complementarily engaging one another.

13. The kit of claim 12, further including a plurality of brim components.

14. The kit of claim 12, wherein the elongated attachment component is formed from an extruded foamed polymer.

15. The kit of claim 12, wherein the female connection portion is formed as a groove configured to slidingly receive the male connection portion.

16. The kit of claim 12, wherein at least one of the male connection portion or the female connection portion includes a registration element.

17. A system for a configurable article of headwear comprising:

one or more crown components, each crown component having a perimeter edge; one or more brim components; and one or more elongated attachment components, wherein the elongated attachment components are each configured to releasably attach the brim components to the crown components, wherein the elongated attachment component includes a flange element and a female connection portion, and the brim component includes a male connection portion, and wherein the female connection portion includes a channel element configured for receiving the male connection portion in a first plane that is transverse the flange element, wherein the brim component includes the male connection portion and wherein the male connection portion lies in substantially the same plane as the remainder of the brim component, and the flange element extending initially in a second direction opposite the first direction toward the perimeter edge and then upwardly along the crown component when the brim component is attached to the crown component, wherein the brim components each include the other of the female connection portion and the male connection portion, and wherein the female connection portion and the male connection portion are configured for complementarily engaging one another.

18. The system of claim 17, wherein the one or more crown components is a plurality of crown components, and at least some of the plurality of crown components having different characteristics from other of the plurality of crown components.

19. The system of claim 17, wherein the one or more brim components is a plurality of brim components, and at least some of the plurality of brim components having different characteristics from other of the plurality of brim components.

20. The system of claim 17, wherein the one or more elongated attachment components is a plurality of elongated attachment components, and at least some of the plurality of decorative attachment components having different characteristics from other of the plurality of attachment components.

21. The system of claim 17, wherein the female connection portion includes a channel element configured for receiving the male connection portion in a first plane that is transverse the flange element.

22. The system of claim 21, wherein the channel element is oriented at a substantially right-angle to the flange.

23. The system of claim 17, wherein one or more of the elongated attachment components are formed from an extruded foamed polymer.

24. The system of claim 17, wherein one or more of the brim components includes the male connection portion and wherein the male connection portion lies in substantially the same plane as the remainder of the brim component.

25. An article of headwear comprising:

a crown component having an exterior major surface that faces outwardly, an inwardly facing surface, and a perimeter edge;

a brim component having an exterior major surface that faces outwardly and an inwardly facing surface;

an elongated attachment component having an elongated length, the elongated attachment component including a flange element that attaches to the crown component and a female-type engagement element projecting transversely from a major surface of the flange element;

wherein the flange element extends initially away from the female-type engagement element in a second direction opposite the first direction toward the perimeter edge of the crown component and then upwardly along the crown component, wherein the female-type engagement element has first and second arms defining a channel extending along the elongated length of the elongated attachment component, and wherein the elongated attachment component is located above the brim component on at least one of the exterior major surfaces such that the channel opens in a direction that extends away from the at least one of the exterior major surfaces.

26. The article of headwear of claim 25, wherein the elongated attachment component is located on the exterior major surface of the brim component.

27. The article of headwear of claim 25, wherein a decorative attachment component is located on the exterior major surface of the crown component.

28. The article of headwear of claim 25, wherein the elongated attachment component is permanently attached to at least one of the exterior major surfaces.

29. The article of headwear of claim 25, wherein that elongated attachment component comprises a first elongated attachment component and a second elongated attachment component, wherein the first elongated attachment component is located on the exterior major surface of the brim component and the second elongated attachment component is located on the exterior major surface of the crown component.

30. The article of headwear of claim 25, wherein a decorative attachment component extends in a dorsal direction.

31. The article of headwear of claim 25, wherein the elongated attachment component extends in a direction transverse to the dorsal direction.

32. The article of headwear of claim 25, wherein a decorative attachment component is located on a centerline of the brim component.

33. The article of headwear of claim 25, wherein a decorative attachment component is located on a centerline of the crown component.

34. The article of headwear of claim 25, further including: a decorative element having a connection region configured for insertion into the channel.

35. The article of headwear of claim 34, wherein the decorative attachment component is configured for releasable engagement to the decorative element.

36. The article of headwear of claim 25, wherein the article of headwear is a baseball cap with a decorative assembly attached.

* * * * *